US009695569B1

(12) United States Patent
Knowles

(10) Patent No.: US 9,695,569 B1
(45) Date of Patent: Jul. 4, 2017

(54) MANHOLE COVER SEALING DEVICE

(71) Applicant: Roger W. Knowles, Euless, TX (US)

(72) Inventor: Roger W. Knowles, Euless, TX (US)

( * ) Notice: Subject to any disclaimer, the term of this patent is extended or adjusted under 35 U.S.C. 154(b) by 0 days.

(21) Appl. No.: 15/201,008

(22) Filed: Jul. 1, 2016

(51) Int. Cl.
*E02D 29/14* (2006.01)

(52) U.S. Cl.
CPC ..... *E02D 29/1436* (2013.01); *E02D 29/14* (2013.01)

(58) Field of Classification Search
CPC ..... E02D 29/14; E02D 29/1436
See application file for complete search history.

(56) References Cited

U.S. PATENT DOCUMENTS 2,693,100 A * 11/1954 Wiegel ..... E02D 29/1427 292/64
3,712,009 A 1/1973 Campagna
3,798,848 A * 3/1974 Campagna ..... E02D 29/14 52/198
4,067,659 A 1/1978 Campagna, Jr. et al.
4,512,492 A * 4/1985 Graybeal ..... E02D 29/14 220/203.28
4,650,365 A 3/1987 Runnels
4,690,584 A * 9/1987 LeBaron ..... E02D 29/1427 404/26
4,919,564 A 4/1990 Neathery et al.
4,969,770 A * 11/1990 Bowman ..... E02D 29/14 404/26
5,051,022 A * 9/1991 Bowman ..... E02D 29/14 404/26
5,326,188 A * 7/1994 Bowman ..... E02D 29/14 292/256.71
5,611,640 A * 3/1997 Bowman ..... E02D 29/1409 404/26
5,727,351 A * 3/1998 Neathery ..... E02D 29/12 292/237
5,743,673 A * 4/1998 Bravo ..... E02D 29/149 404/25
6,464,425 B1 10/2002 Closkey
7,165,911 B2 * 1/2007 Fier ..... E02D 29/1409 404/25
7,744,305 B2 * 6/2010 Choi ..... E02D 29/14 404/25
8,851,791 B1 10/2014 Putnam
2007/0116518 A1 5/2007 Tortorici

FOREIGN PATENT DOCUMENTS

WO 9116505 10/1991

* cited by examiner

*Primary Examiner* — Abigail A Risic
(74) *Attorney, Agent, or Firm* — Law Office of Jeff Williams; J. Oliver Williams

(57) ABSTRACT

A device for sealing the opening of a manhole. The device includes a seal coupled to a lid; a valve; and a compression inducing device. The lid is set within an existing manhole frame and operates without modification. The seal is coupled to a lower surface of the lid and contacts a lip within the frame. The seal is compressed to the lip and the compression inducing device is used to grip the frame below the lip to maintain the compressive state of the seal. The manhole cover is placed on top of the lid. Gases escape through the valve. Water or moisture is prevented from passing through the seal or valve. One or more grooves or ribs are optionally included to create a gap between the lid and the manhole cover for the routing of released gases.

20 Claims, 4 Drawing Sheets

MANHOLE COVER SEALING DEVICE

BACKGROUND

1. Field of the Invention

The present application relates generally to sealing a manhole opening against ground water infiltration, and more particularly to an article to rest beneath the manhole cover in the existing opening.

2. Description of Related Art

In many urban areas, the growth and sprawl of towns and cities has decreased the amount of ground surface area which is available for absorbing moisture from rain and snow. Accordingly, this water must be drained off and disposed of through suitable means. In some instances where rainfall is minimal, it is possible to collect this water and dispose of it through the city sewer system. Sewer systems are constructed to accommodate a maximum level of influent to be expected at any one time. As long as the amount of water is minimal, conventional sewer systems may be able to process this without much risk. In areas where rainfall and snowfall is more extreme, conventional sewer systems are not capable of handling the runoff without a gross overdesigning of the system.

A basic fact is that rainfall disposed of through the sewer system has to be processed. Whether the sewer system is designed to accommodate runoff collection or not, the act of processing the runoff costs money. Where moisture is minimal, this cost is not significant. However, where moisture is more prevalent, this cost is non-trivial. Such costs can quickly rise and become a hindrance to city budgets. Therefore, costs associated with processing the moisture through a sewer system is not only costly at the time of building the system but also in the act of processing every gallon that passes through the system. Disadvantages of processing moisture through the sewer system include: higher costs, increased wear and tear on the system, and decreased efficiency to oversize the entire sewer system to accommodate rainfall and sewage.

Some towns or cities have developed a storm drain system to collect and route the moisture away through selected drain systems, away from sewer systems. These have done well but are not completely perfect. Localized flooding still occurs. Additionally, during rainy weather an average manhole in a sanitary sewer system can contribute from 3,000 to 12,000 gallons per day of rainwater to the sewer system for treatment. Although storm drain systems help, they are not enough to avoid the extra costs associated with processing runoff from moisture.

A device is needed that acts to seal or prevent the runoff from entering the manholes. Such a device would act to substantially reduce costs and wear to existing sewer treatment systems. A typical manhole includes a main chamber or barrel section to which the sewer pipes connect. That section is topped with a conical riser upward to a size needed to fit a metal frame for the manhole cover. The metal frame includes an internal lip to support the manhole cover. Water typically passes around the cover because the cover and frame are not sealed.

Many devices have been developed to try and seal manholes to prevent the undesired passing of storm water and other moisture. They can include dishes, bowls, and internally translating sealing sleeves to name a few. Such devices usually become quite complex and involve the reworking and construction of the manhole itself. Such work and cost, given the sheer number of manholes, is undesirable.

It is desirable to have a device that is configured to seal the opening of the manhole and operate with existing manhole frames to avoid the need to reconstruct the manhole assembly. Although some strides have been made, considerable shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
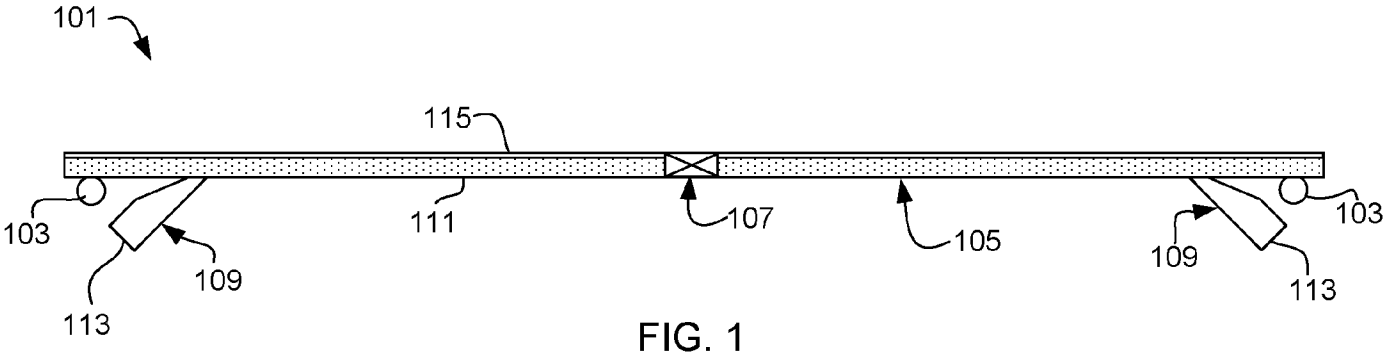
FIG. 1 is a side view of a manhole cover sealing device according to the preferred embodiment of the present application.

While the system and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

The system in accordance with the present application overcomes one or more of the above-discussed problems commonly associated with conventional manhole covers. Specifically, the manhole cover sealing device of the present application is configured to be located between the manhole cover and the internal lip of the manhole frame. The device is configured to have a seal that seals along the lip around the full circumference of the lip. The device includes a valve to permit the escaping of gas from the sewer while preventing the passage of moisture into the sewer. Additionally, the device includes a plurality of compression inducing devices that extend into the throat of the manhole and act to initiate a compressive lock. This compressive lock secures device in place to ensure a compressed seal is maintained. This is important given the frequent miss-fitting nature of manhole covers in the frame wherein the cover rocks side to side or fails to actually provide a uniform seating along the lip. The compressive locking feature therefore maintains the seal in a compressed state independent of the fit and weight of the cover itself. These and other unique features of the device are discussed below and illustrated in the accompanying drawings.

The device and method will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The manhole cover sealing device of the present application is illustrated in the associated drawings. The device includes seal and a plurality of compression inducing devices configured to maintain the seal in a compressed state. A one-way valve is also included to allow for the passage of sewage gas and restrict water entrance.

Referring now to the drawings wherein like reference characters identify corresponding or similar elements in form and function throughout the several views. FIGS. 1-4 in the drawings illustrate manhole cover sealing device 101. As stated previously, device 101 includes a seal 103, a lid 105, a valve 107, and one or more compression inducing members 109. Device 101 is configured to ideally operate within a manhole opening, however, it is understood that the functions and features of device 101 are not so limited. Device 101 may be used with any opening (i.e. a sleeve), whether of one or multiple internal diameters. Lid 105 may be compressed along the upper surface of an opening as opposed to an internal lip herein described.

Figure 2:
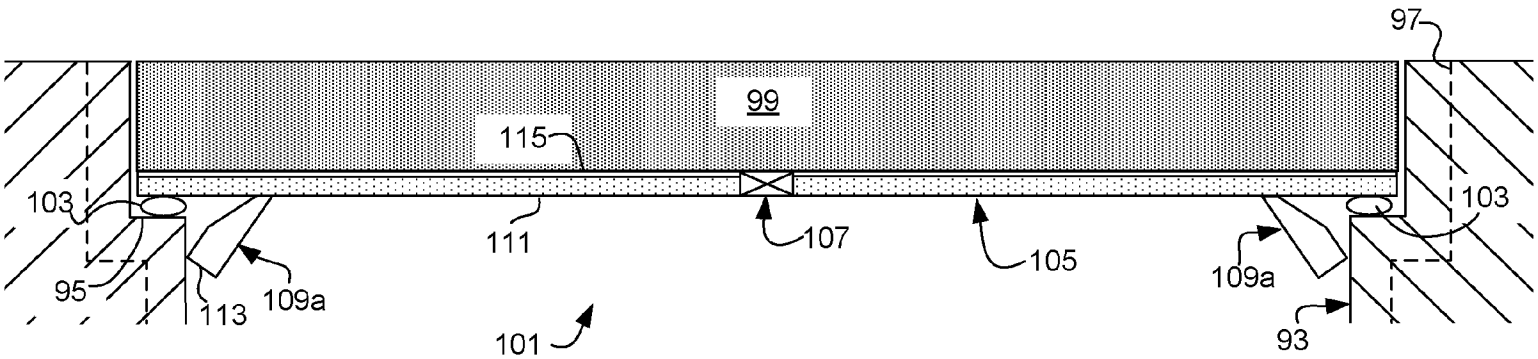
FIG. 2 is a side view of the manhole cover sealing device of FIG. 1 within a manhole.

As seen in FIG. 2, device 101 is shown in a manhole opening. A manhole opening is defined as the opening made for the acceptance of a conventional manhole cover 99. It is typically relatively flush with street level and provides an access point for workers to enter the sewer system of a city. A frame 97 is defined in the street (or other surface location) to accept manhole cover 99. An internal lip 95 is defined in the frame to prevent the falling of the manhole cover 99 through the opening. A throat area 93 of the frame 97 is the decreased diameter portion just below the lip 95 of the frame 97.

As seen in FIG. 1, lid 105 is a relatively rigid member made from one or more materials and is configured to enter into the opening of frame 95. Ideally, lid 105 is sized to be slightly smaller than the internal diameter of the opening. Lid 105 is constructed to support the weight of an individual standing at its center to prevent accidental injury from falling into the sewer. Seal 103 is configured to engage frame 97 and restrict passage of gases, solids, and liquids from passing through frame 97. Seal 103 is coupled to a lower surface 111 of lid 104 and engages lip 95. Seal 103 is operated by compressing lid 105 into lip 95. As seen in FIG. 2, seal 103 is in a compressed state. Seal 103 is configured to be any type of flexible material that is resistant to absorption. Examples may include elastomeric materials, rubber, and so forth. Seal 103 is configured to wrap around the full circumference of lid 105 along lower surface 111.

Valve 107 is coupled to lid 105 and is configured to restrict the passage of moisture through the manhole opening. One example of valve 107 is a one-way valve wherein it is designed to allow for gases within the sewer, below lid 105, to pass upward and into the ambient air. This avoids dangers associated with potential build-up of methane and other gases in the sewer systems. However, as a one-way valve, valve 107 is configured to prevent the passage of moisture (i.e. water) back through lid 105 and into the sewer. Both seal 103 and valve 107 together operate to prevent the passage of moisture into the sewer. This has the advantage of minimizing the amount of water runoff or rain that enters the sewer system and therefore has to be processed and treated.

Device 101 further includes compression inducing device 109. Device 109 is configured to locate lid 105 within frame 97 and to maintain seal 103 in a compressed state. Device 109 is composed of one or more members that act to engage and grip frame 97 in the throat area 93, such that when lid 105 is pressed down into the manhole opening and against lip 95, device 109 produces a sufficient outward force against throat 93 so as to maintain the relative compressive position of lid 105 within frame 97. This position is independent of the placement of cover 99. Device 101 does not rely upon the weight of cover 99 to compress seal 103.

An example of compression inducing device 109 is that of a tang that is cantilevered from lower surface 111 of lid 105. Tang **109*a* is configured to flex in relative position to that of lower surface 111. Tang 109*a* includes a first surface 113. When in a relaxed state, tang 109*a* is in a first position forming more of an acute angle relative to lower surface 111. When installed in frame 97, tang 109*a* flexes inward into a second position. The second position results in an increased angle relative to lower surface 111. Additionally, the pressure or force to flex tang 109*a* is used to grip frame 97 and maintain the compressive state of seal 103. Surface 113 is angled to allow tang 109*a* to flex inward as it contacts lip 95 when being installed. To remove device 101, an upward force is applied to pull it out of frame 97**.

Figure 3:
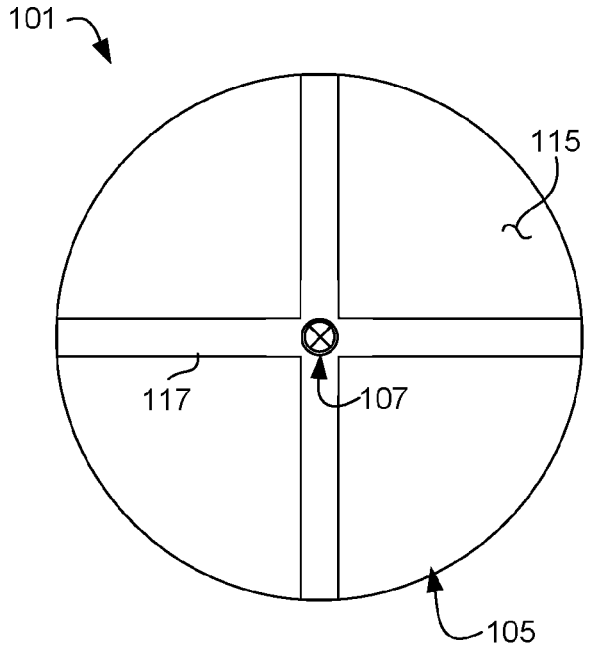
FIG. 3 is a top view of the manhole cover sealing device of FIG. 1.
Figure 4:
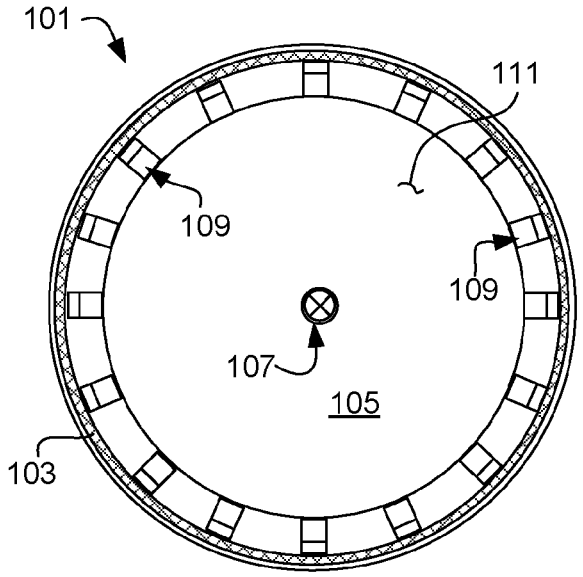
FIG. 4 is a bottom view of the manhole cover sealing device of FIG. 1.
Figure 5:
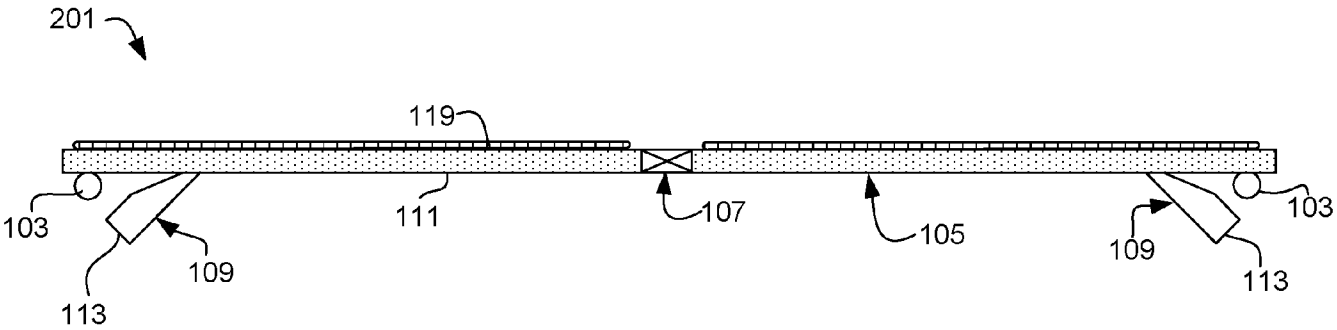
FIG. 5 is a side view of an alternative embodiment of the manhole cover sealing device of FIG. 1.
Figure 6:
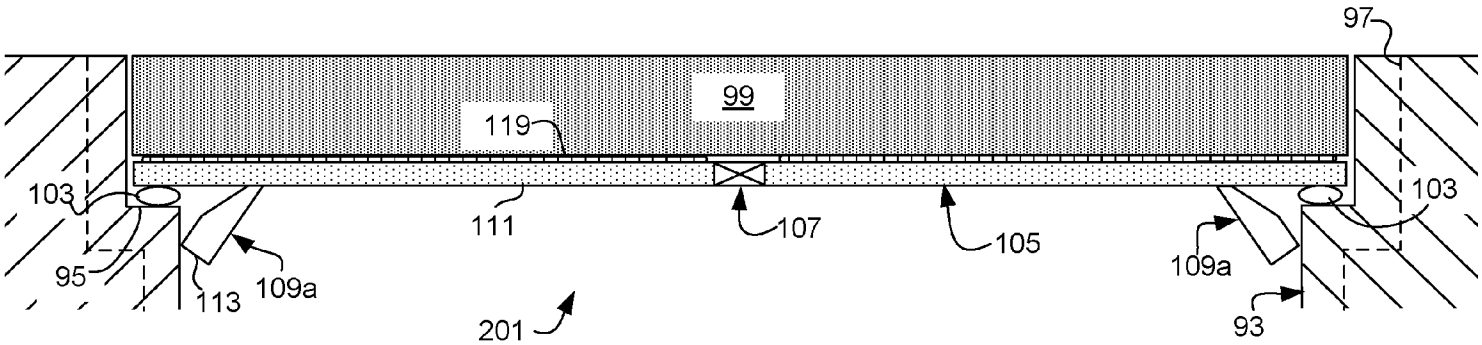
FIG. 6 is a side view of the manhole cover sealing device of FIG. 5 within a manhole.
Figure 7:
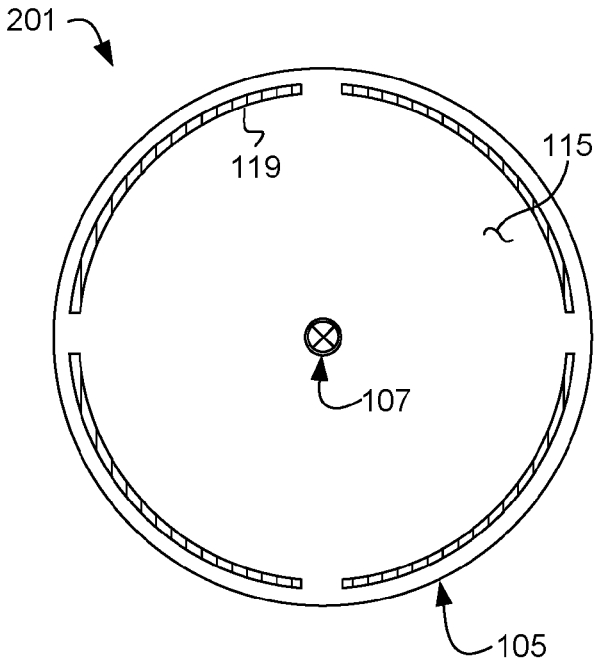
FIG. 7 is a top view of the manhole cover sealing device of FIG. 5.
Figure 8:
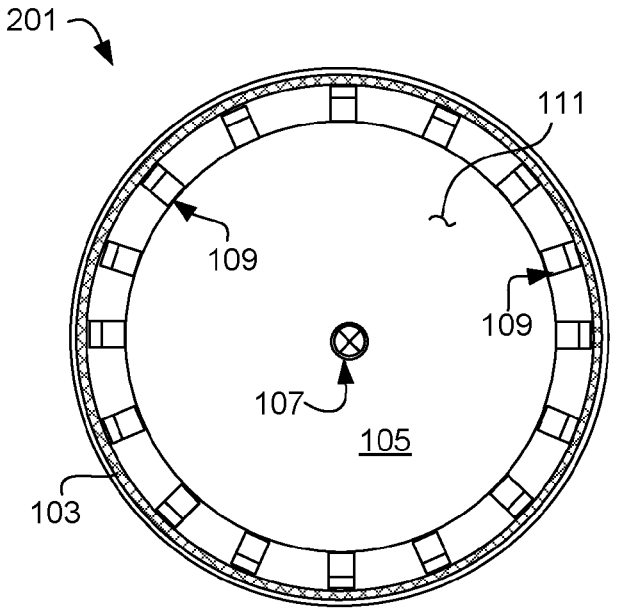
FIG. 8 is a bottom view of the manhole cover sealing device of FIG. 5.

Referring in particular to FIG. 3, an optional groove 117 is formed into an upper surface 115 of lid 105. Groove 117 is configured to provide a gap between the lid 105 and cover 99 to permit the escaping of gas through valve 107. Depending on the design of cover 99, additional space may be required to ensure exhausting gas has a route out of the volume of air defined by frame 97.

Referring now also to FIGS. 5-8 in the drawings, an alternative embodiment to device 101 is illustrated. Manhole cover sealing device 201 is similar in form and function to that of device 101 of FIGS. 1-4. Like reference characters identify corresponding or similar elements in form and function throughout the several views. The operation and function of the various features of device 201 are similar to that of device 101 except as noted herein. Device 201 is configured to use a different method of creating a gap of space between lid 105 and cover 99. Device 201 uses a rib 119 to separate the bottom surface of cover 99 from upper surface 115 of lid 105. The pattern of rib 119 may be varied for selected purposes. Additionally, the height can be chosen based upon design characteristics. Rib 119 is formed on upper surface 115 and configured to provide the gap between cover 99 and lid 105 to permit the escaping of gas through valve 107.

In operation of either device 101 or device 201, lid 105 is located relative to the frame of the manhole. The lid is rested within the frame adjacent lip 95. Seal 103 contacts lip 95 around the full circumference of the frame. Pressure is applied to the top of lid 105 to compress seal 103. Devices 109 are used to secure the lid in the compressed position by gripping the throat of the frame. The cover 99 is laid atop of lid 105. Cover 99 may be laid atop before or after lid 105 is set and compressed.

Along with the spirit of the application, lid 105 may be applied to a hole or sleeve end wherein device 109 is used to grip the internal surfaces of the hole and the seal is applied to the outer upper surface of the hole. Interference fit is used to secure device 109 to the frame and/or surface of the hole.

The current application has many advantages over the prior art including at least the following: (1) water-tight seal around the fame of the manhole to prevent the passage of water into the sewer system; (2) a valve configured to permit the release of gas; (3) a compression inducing device configured to translate within the frame and maintain the compressed state of the seal; (4) simplistic operation and design; and (5) fits existing conventional manholes negating the need to reconstruct the manhole to use.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A manhole cover sealing device for a manhole, comprising:

a lid located between a manhole cover and a lip of a manhole frame;

a seal coupled to a lower surface of the lid and configured to engage the lip;

a one-way valve configured to selectively restrict the passage of moisture through the manhole; and a compression inducing device configured to locate the lid in the manhole and maintain the seal in a compressed state between the lid and the lip, the compression inducing device pressing radially outward along a vertical face of the lip such that the compression inducing device remains wholly within an innermost internal dimension of a throat portion of the manhole frame.

2. The device of claim 1, wherein the compression inducing device is a tang cantilevered from a lower surface of the lid.

3. The device of claim 2, wherein the tang is configured to flex relative to the lower surface of the lid.

4. The device of claim 1, wherein the compression inducing device is configured to contact the throat portion of the manhole.

5. The device of claim 1, wherein the lid is secured to the frame of the manhole independent of the manhole cover.

6. The device of claim 1, wherein the lid is configured to seal the opening of the throat of the manhole when the seal is in a compressed state.

7. The device of claim 1, wherein the valve is operably associated with the lid, the valve passing through the lid.

8. The device of claim 1, wherein the lid is configured to support the weight of an individual.

9. The device of claim 1, wherein the lid is removed by pulling the lid upward out of the manhole.

10. The device of claim 1, further comprising:

a raised rib on an upper surface of the lid configured to provide a gap between the lid and the manhole cover to permit the escaping of gas through the valve.

11. The device of claim 1, further comprising:

a groove in the lid configured to provide a gap between the lid and the manhole cover to permit the escaping of gas through the valve.

12. A method of sealing a manhole, comprising:

locating a lid relative to a manhole, the lid resting within the frame of the manhole;

compressing a seal between the lid and the frame of the manhole;

permitting the passage of gas and moisture through a valve in the lid, such that the moisture escapes out of the manhole and corresponding sewer system; and securing the seal in a compressed state by utilizing a compression inducing device configured to engage the frame of the manhole, the compression inducing device pressing radially outward along a vertical face of the lip such that the compression inducing device remains wholly within an innermost internal dimension of a throat portion of the manhole frame.

13. The method of claim 12, wherein the lid is located between a manhole cover and a lip of the frame.

14. The method of claim 12, wherein the seal is compressed between a lip of the frame and the lid, the seal located on a lower surface of the lid.

15. The method of claim 12, wherein the compression inducing device is a tang cantilevered from a lower surface of the lid.

16. The method of claim 12, wherein the compression inducing device is configured to contact the manhole frame within the throat of the manhole frame.

17. A cover sealing device for a hole, comprising:

a lid located above the hole;

a seal coupled to a lower surface of the lid and configured to engage a top portion of the hole;

a valve configured to restrict the passage of moisture through the lid and also through the hole; and a compression inducing device configured to locate the lid in the hole and maintain the seal in a compressed state, the compression inducing device pressing radially outward along a vertical face of the lip such that the compression inducing device remains wholly within an innermost internal dimension of a throat portion of the manhole frame so as to permit removal through the application of an upward force.

18. The device of claim 17, wherein the compression inducing device maintains the compressed state of the seal through an interference fit with the hole.

19. The device of claim 17, wherein the compression inducing device is a tang cantilevered from a lower surface of the lid.

20. The device of claim 18, wherein the tang is configured to flex relative to the lower surface of the lid.

* * * * *